US009222034B2

(12) United States Patent
Bedard et al.

(10) Patent No.: US 9,222,034 B2
(45) Date of Patent: Dec. 29, 2015

(54) PROCESS FOR REMOVING A PRODUCT FROM COAL TAR

(71) Applicant: UOP LLC, Des Plaines, IL (US)

(72) Inventors: Robert L. Bedard, McHenry, IL (US); Jayant K. Gorawara, Buffalo Grove, IL (US); Deng-Yang Jan, Elk Grove Village, IL (US); Gregory F. Maher, Aurora, IL (US); Dean E. Rende, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 14/472,255

(22) Filed: Aug. 28, 2014

(65) Prior Publication Data

US 2015/0141701 A1 May 21, 2015

Related U.S. Application Data

(60) Provisional application No. 61/905,898, filed on Nov. 19, 2013.

(51) Int. Cl.

| | |
|---|---|
| ***C07C 45/53*** | (2006.01) |
| ***C07C 37/08*** | (2006.01) |
| ***C07C 2/66*** | (2006.01) |
| ***C10G 25/00*** | (2006.01) |
| ***C10G 67/04*** | (2006.01) |
| ***C10G 1/00*** | (2006.01) |
| ***C10G 21/12*** | (2006.01) |
| ***C10G 53/06*** | (2006.01) |
| ***C10G 53/08*** | (2006.01) |
| ***C10G 67/06*** | (2006.01) |
| ***C10G 55/06*** | (2006.01) |
| ***C10G 57/00*** | (2006.01) |
| ***C10G 33/00*** | (2006.01) |
| ***C10G 53/14*** | (2006.01) |

(52) U.S. Cl.

CPC ..... *C10G 25/003* (2013.01); *C10G 1/002* (2013.01); *C10G 21/12* (2013.01); *C10G 33/00* (2013.01); *C10G 53/06* (2013.01); *C10G 53/08* (2013.01); *C10G 53/14* (2013.01); *C10G 55/06* (2013.01); *C10G 57/005* (2013.01); *C10G 67/0418* (2013.01); *C10G 67/0445* (2013.01); *C10G 67/06* (2013.01); *C10G 2400/30* (2013.01)

(58) Field of Classification Search

CPC ..... C07C 2/66; C07C 45/53; C07C 37/08

USPC ..... 568/397, 768; 585/323, 446

See application file for complete search history.

(56) References Cited

U.S. PATENT DOCUMENTS

| | | | |
|---|---|---|---|
| 1,937,941 | A | 12/1933 | Braun |
| 4,297,206 | A | 10/1981 | Scheibel |
| 4,492,674 | A | 1/1985 | Schweighardt |
| 4,493,765 | A | 1/1985 | Long et al. |
| 4,634,680 | A | 1/1987 | Kingsley |
| 4,827,050 | A | 5/1989 | Peter et al. |
| 5,002,655 | A | 3/1991 | Ukegawa et al. |
| 5,338,442 | A | 8/1994 | Siskin et al. |
| 6,232,518 | B1 | 5/2001 | Ou |
| 6,544,409 | B2 | 4/2003 | De Souza |
| 7,658,901 | B2 | 2/2010 | Prud'Homme et al. |
| 7,731,840 | B1 | 6/2010 | Mallonee et al. |
| 2007/0151901 | A1 | 7/2007 | Sain et al. |
| 2008/0045687 | A1 | 2/2008 | Nguyen et al. |
| 2013/0030131 | A1 | 1/2013 | Deeth et al. |

FOREIGN PATENT DOCUMENTS

| | | | |
|---|---|---|---|
| CN | 2429523 | | 5/2001 |
| CN | 1777665 | | 5/2006 |
| CN | 1952071 | | 4/2007 |
| CN | 101033410 | A | 9/2007 |
| CN | 101575537 | | 11/2009 |
| CN | 101724461 | | 6/2010 |
| CN | 102795684 | | 11/2012 |
| CN | 103059894 | A | 4/2013 |
| CN | 103215058 | A | 7/2013 |
| EP | 0097755 | | 3/1987 |
| GB | 365571 | | 1/1932 |
| GB | 846172 | | 8/1960 |
| GB | 2096636 | | 10/1982 |
| JP | 2003064380 | | 3/2003 |

OTHER PUBLICATIONS

Search Report dated Feb. 26, 2015 for corresponding PCT Application No. US2014/064497.

Mahlambi et al., "Polymerization of cyclodextrin-ionic liquid complexes . . . ," Ionic Liquids: Applications and Perspectives (2011), InTech Publishing, 115-150.

Dutta, Monalisa, "Enhanced flushing with cyclodextrin for the remediation of creosote contaminated soil," Thesis—Louisiana State University (2004), 1-84.

Kawauchi et al., "Formation of the inclusion complex of helical syndiotactic poly(methyl methacrylate) . . . ," Macromolecules (2011), 44th, 3452-3457.

He et al., "Interaction between ionic liquids and β-cyclodextrin . . . " Journal of Physical Chemistry B (2009), 113(1), 231-238.

Rogalski et al., "Physico-chemical properties and phase behavior of the ionic . . . ," International Journal of Molecular Sciences (2013), 14th, 16638-16655.

Zheng et al., "The enhanced dissolution of β-cyclodextrin in some hydrophilic ionic liquids," Journal of Physical Chemistry A (2010), 114th, 3926-3931.

(Continued)

*Primary Examiner* — Sikarl Witherspoon

(57) ABSTRACT

A process for removing at least one product from coal tar is described. The process involves extraction with an extraction agent or adsorption with an adsorbent. The extraction agent includes at least one of amphiphilic block copolymers, cyclodextrins, functionalized cyclodextrins, and cyclodextrin-functionalized polymers, and the adsorbent includes exfoliated graphite oxide, thermally exfoliated graphite oxide or intercalated graphite compounds.

18 Claims, 1 Drawing Sheet

(56) References Cited

OTHER PUBLICATIONS

Velasquez at al., "Poly(vinylidene chloride)-based amphiphilic block copolymers," Macromolecules (2013), 46th, 664-673.
Qiao et al., "Stabilized micelles of amphoteric polyurethane formed by thermoresponsive micellization in HCI aqueous solution," Langmuir (2008), 24th, 3122-3126.
Tryba et al., "Exfoliated graphite as a new sorbent for removal of engine oils from wastewater," SpillScience & Technology Bulletin (2003), 8(5-6), 569-571.
Uemasu, Isamu, "Effect of methanol-water mixture solvent on concentration of indole . . . ," Sekiyu Gakkaishi (1991), 34(4), 371-374.
Tungittiplakorn et al., "Engineered polymeric nanoparticles for soil remediation," Environmental Science & Technology (2004), 38(5), 1605-1610.
Tryba et al., "Influence of chemically prepared H2SO4-graphite intercalation compound (GIC) precursor . . . ," Carbon (2002), 41st, 2009-2025.
Ondo et al., "Interaction of ionic liquids ions with natural cyclodextrins," Journal of Physical Chemistry B (2011), 115th, 10285-10297.
Hristea et al., "Characterization of exfoliated graphite for heavy oil sorption," Journal of Thermal Analysis and Calorimetry (2008), 91(3), 817-823.
Tungittiplakorn et al., "Engineered polymeric nanoparticles for bioremediation of hydrophobic contaminants," Environmental Science & Technology (2005), 39(5), 1354-1358.
Toyoda et al., "Heavy oil sorption using exfoliated graphite . . . ," Carbon (2000), 38th, 199-210.
Kodera et al. "Methanol-mediated extraction of phenolic and nitrogen compounds . . . ," Chemical Abstracts from Internat'l Conference of Coal Science (1993), 122(22), 307-310.
Kodera et al. "Solvent extraction of nitrogen compounds from coal liquids," Fuel (1991), 70(6), 765-769.
Li et al. "Ionic liquids to extract valuable components from direct coal liquefaction residues" Fuel (2012), vol. 94, 617-619.
Miura, Kouichi, "Mild conversion of coal for producing valuable chemicals," Fuel Processing Technology (2000), 62(2-3), 119-135.
Mochida et al. "Carbonization of coal tar pitch denitrogenated by metal sulfates," Carbon (1992), 30(2), 241-246.
Mochida et al. "Removal of basic nitrogen species in coal-tar pitch by metal sulphates supported on silica gel," Fuel (1991), 70(6), 761-764.
Nie et al. "Study on extraction asphaltenes from direct coal liquefaction residue with ionic liquids," Industrial & Engineering Chemistry Research (2011), 500, 10278-10282.
Peters et al. "Coal tar dissolution in water-miscible solvents . . . " Environmental Science Technology (1993), 27(13), 2831-2843.
Kim et al. "Liquid membrane permeation of nitrogen heterocyclic compounds . . . ," Bulletin of the Korean Chemical Society (2010), 31(5), 1143-1148.
Kim et al. "Separation of nitrogen heterocyclic compounds from model coal tar fraction by solvent extraction," Separation Science and Technology (2005), 40(10), 2095-2109.
Ukegawa et al. "Solvent extraction of nitrogen compounds from a coal tar fraction . . . " Journal of the Japan Petroleum Institute (1990), 33(4), 250-254.
Wu et al., "Removal of tar base from coal tar aromatics employing solid acid adsorbents," Separation and Purification Technology (2000), vol. 21, 145-153.
Janik, M. "Properties of coal tar pitch," Chemical Prum (1970), 20(45), 467-472.

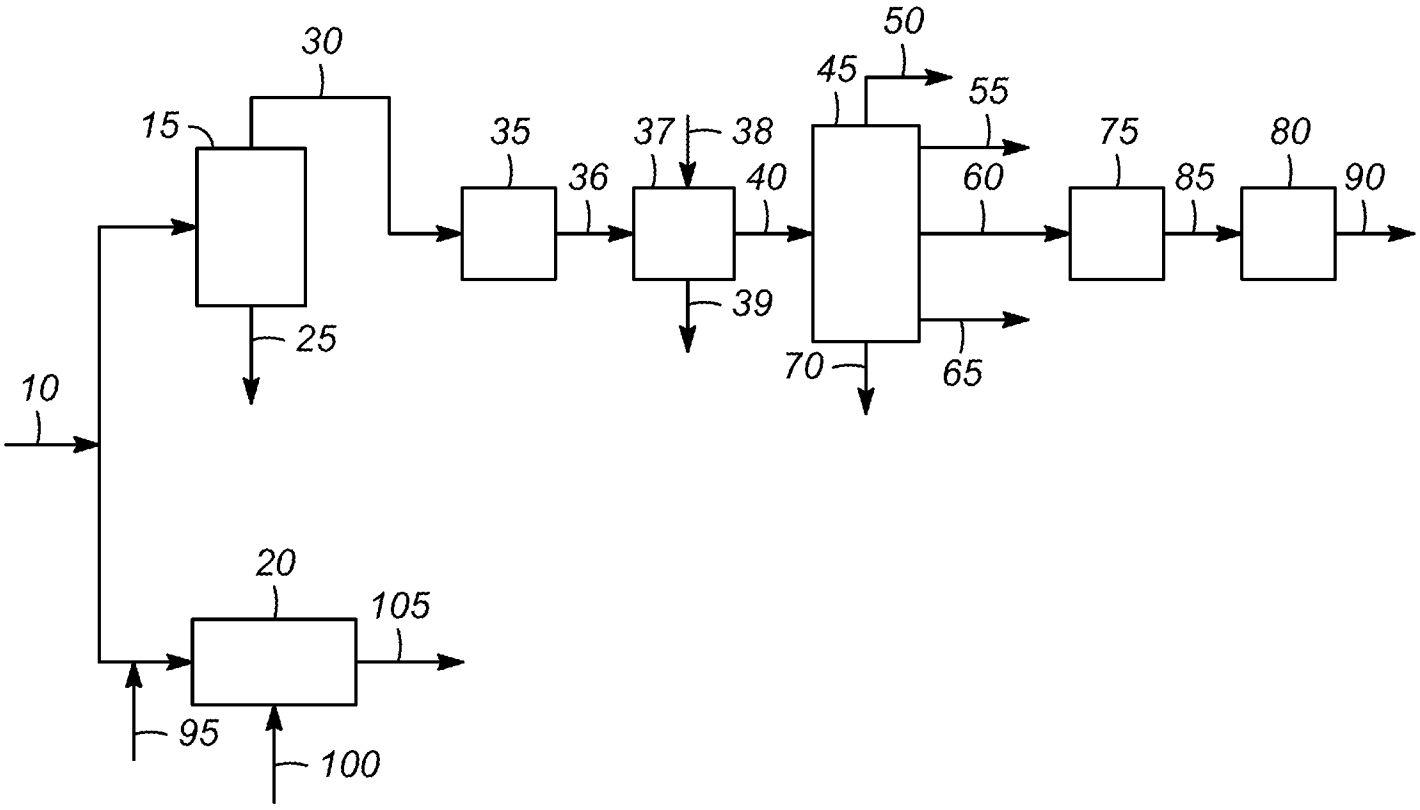
10
15
20
25
30
35
36
37
38
39
40
45
50
55
60
65
70
75
80
85
90
95
100
105

PROCESS FOR REMOVING A PRODUCT FROM COAL TAR

This application claims the benefit of Provisional Application Ser. No. 61/905,898 filed Nov. 19, 2013, entitled Process for Removing a Product from Coal Tar.

BACKGROUND OF THE INVENTION

Many different types of chemicals are produced from the processing of petroleum. However, petroleum is becoming more expensive because of increased demand in recent decades.

Therefore, attempts have been made to provide alternative sources for the starting materials for manufacturing chemicals. Attention is now being focused on producing liquid hydrocarbons from solid carbonaceous materials, such as coal, which is available in large quantities in countries such as the United States and China.

Pyrolysis of coal produces coke and coal tar. The coke-making or "coking" process consists of heating the material in closed vessels in the absence of oxygen to very high temperatures. Coke is a porous but hard residue that is mostly carbon and inorganic ash, which is used in making steel.

Coal tar is the volatile material that is driven off during heating, and it comprises a mixture of a number of hydrocarbon compounds. It can be separated to yield a variety of organic compounds, such as benzene, toluene, xylene, naphthalene, anthracene, and phenanthrene. These organic compounds can be used to make numerous products, for example, dyes, drugs, explosives, flavorings, perfumes, preservatives, synthetic resins, and paints and stains but may also be processed into fuels and petrochemical intermediates. The residual pitch left from the separation is used for paving, roofing, waterproofing, and insulation.

There is a need for improved processes for removing products from coal tar.

SUMMARY OF THE INVENTION

One aspect of the invention is a process for removing at least one product from coal tar. In one embodiment, the process includes pyrolyzing a coal feed into a coal tar stream and a coke stream; removing at least one product from the coal tar stream by extraction with an extraction agent or adsorption with an adsorbent to form a treated coal tar steam, the extraction agent comprising at least one of amphiphilic block copolymers, inclusion complexes of poly(methyl methacrylate) and polycyclic aromatic hydrocarbons, cyclodextrins, functionalized cyclodextrins, and cyclodextrin-functionalized polymers, and the adsorbent comprising exfoliated graphite oxide, thermally exfoliated graphite oxide or intercalated graphite compounds; recovering the at least one product; and separating the treated coal tar stream into at least two fractions.

BRIEF DESCRIPTION OF THE DRAWING

The FIGURE is an illustration of one embodiment of the process of the present invention.

DETAILED DESCRIPTION OF THE INVENTION

The FIGURE shows one embodiment of a coal conversion process 5. The coal feed 10 can be sent to the pyrolysis zone 15, the gasification zone 20, or the coal feed 10 can be split into two parts and sent to both.

In the pyrolysis zone 15, the coal is heated at high temperature, e.g., up to about 2,000° C. (3600° F.), in the absence of oxygen to drive off the volatile components. Coking produces a coke stream 25 and a coal tar stream 30. The coke stream 25 can be used in other processes, such as the manufacture of steel.

The coal tar stream 30 which comprises the volatile components from the coking process can be sent to an optional contaminant removal zone 35, if desired.

The contaminant removal zone 35 for removing one or more contaminants from the coal tar stream or another process stream may be located at various positions along the process depending on the impact of the particular contaminant on the product or process and the reason for the contaminant's removal, as described further below. For example, the contaminant removal zone 35 can be positioned upstream of the separation zone 45, as shown in the FIGURE. Some contaminants have been identified to interfere with a downstream processing step or hydrocarbon conversion process, in which case the contaminant removal zone 35 may be positioned upstream of the separation zone 45 or between the separation zone 45 and the particular downstream processing step at issue. Still other contaminants have been identified that should be removed to meet particular product specifications. Where it is desired to remove multiple contaminants from the hydrocarbon or process stream, various contaminant removal zones may be positioned at different locations along the process. In still other approaches, a contaminant removal zone may overlap or be integrated with another process within the system, in which case the contaminant may be removed during another portion of the process, including, but not limited to the separation zone or the downstream hydrocarbon conversion zone. This may be accomplished with or without modification to these particular zones, reactors, or processes. While the contaminant removal zone is often positioned downstream of the hydrocarbon conversion reactor, it should be understood that the contaminant removal zone in accordance herewith may be positioned upstream of the separation zone, between the separation zone and the hydrocarbon conversion zone, or downstream of the hydrocarbon conversion zone or along other streams within the process stream, such as, for example, a carrier fluid stream, a fuel stream, an oxygen source stream, or any streams used in the systems and the processes described herein. The contaminant concentration is controlled by removing at least a portion of the contaminant from the coal tar stream 30. As used herein, the term removing may refer to actual removal, for example by adsorption, absorption, or membrane separation, or it may refer to conversion of the contaminant to a more tolerable compound, or both.

The decontaminated coal tar stream 36 from the contaminant removal zone 35 is sent to a treatment zone 37 for extraction or adsorption.

In an extraction process, an extraction agent stream 38 is introduced into the treatment zone 37 and contacts the decontaminated coal tar stream. The extraction agent stream 38 can be between 1 and 99 wt % of the mixture of extraction agent stream and coal tar stream in the treatment zone. The extraction can be performed at a temperature between 0° C. and 250° C. When the extraction agent contains a supercritical component, the temperature is that required for the supercritical conditions of the chosen supercritical component.

The extraction agent and the product are separated. The extraction agent can be recycled, if desired. At least one product 39 is removed from the decontaminated coal tar stream 36. The product(s) 39 can then be recovered and sent for additional treatment, such as purification, filtration, washing, hydrotreating, or rectification (not shown).

The extraction agent can be one or more of amphiphilic block copolymers, inclusion complexes of poly(methyl methacrylate) and polycyclic aromatic hydrocarbons, cyclodextrins, functionalized cyclodextrins, and cyclodextrin-functionalized polymers.

Cyclodextrins (CDs) are cyclic oligosaccharides. They have a characteristic toroidal shape that form well defined cavities. The cavities are typically about 8 Å deep and have a diameter of about 5 to 10 nm depending on the number of the glucose units. The outside of the cavity is hydrophilic because of the presence of hydroxyl groups, while the inner cavity is hydrophobic because of presence of carbon and hydrogen atoms.

CDs can accommodate guest molecules in the cavity. Typically, the less polar part of the guest molecule is in the cavity, and the more polar part is outside. The hydroxyls on the outside of the CDs can be functionalized, and functionalized CDs can be polymerized. Ionic liquids can be used to functionalize CDs. CDs can be functionalized to modify their properties and/or to introduce groups with specific activity. Functionalization can involve one or more hydroxyl groups.

CDs, functionalized CDs, and CD-functionalized polymers are described in Ondo et al., Interaction of Ionic Liquids Ions with Natural Cyclodextrins, J.Phys.Chem.B, 2011, 115, 10285-10297; He et al., Interaction of Ionic Liquids Ions and β-Cyclodextrin, J.Phys.Chem.B, 2009, 113, 231-238; Mahlambi et al., "Polymerization of Cyclodextrin-Ionic Liquid Complexes for the Removal of Organic and Inorganic Contaminants from Water," InTech 2011, 115-150, www.intechopen.com; Rogalski et al., Physico-Chemical Properties and Phase Behavior of the Ionic Liquid-β-Cyclodextrin Complexes, Int.J.Mol.Sci. 2013, 14, 16638-16655; Zheng et al., The Enhanced Dissolution of β-Cyclodextrin in Some Hydrophilic Ionic Liquids, J.Phys.Chem.A, 2010, 114, 3926-3931; Uemasu, Effect of Methanol-Water Mixture Solvent on Concentration of Indole in Coal Tar Using α-Cyclodextrin as Complexing Agent, Sekiyu Gakkaishi, 34, (4), 371-374 (1991); each of which is incorporated herein by reference.

Inclusion complexes of polymethyl methacrylate and polycyclic aromatic hydrocarbons can also be used as extraction agents. Syndiotactic polymethyl methacrylate can form a helical cavity in which polycyclic aromatic hydrocarbons are contained. Formation of inclusion complexes is described in Kawauchi et al., Formation of the Inclusion Complex of Helical Syndiotactic Poly(methyl methacrylate) and Polycyclic Aromatic Hydrocarbons, Macromolecules, 2011, 44, 3452-3457, which is incorporated herein by reference.

Amphiphilic block copolymers have alternating hydrophilic polymer blocks and hydrophobic polymer blocks. The amphiphilic block copolymer comprises at least two blocks selected from polyethylene oxide (EO) blocks, polypropylene oxide (PO) blocks, butylene oxide (BO) blocks, silicone (SC) blocks, urethane (UO) blocks, polyurethane ionomer (PI) blocks, acrylate ionomer (AI) blocks, polymethylacryate (MA) blocks, polyacrylic acid (AA) blocks, and polyvinylidene chloride (VC) blocks. Examples of suitable amphiphilic block copolymers include, but are not limited to, EO-PO, EO-PO-EO, PO-EO-PO, EO-BO, PI-EO, AI-EO, SI-EO, and the like. There are typically two or three different blocks in the block copolymers.

Amphiphilic block copolymers are described in Tungittiplakorn et al., "Engineered Polymeric Nanoparticles for Soil Remediation," Environ. Sci. Technol. 2004, 38, 1605-1610; Tungittiplakorn et al., "Engineered Polymeric Nanoparticles for Bioremediation of Hydrophobic Contaminants," Environ. Sci. Technol. 2005, 39, 1354-1358; Qiao et al, "Stabilized Micelles of Amphoteric Polyurethane Formed by Thermoresponsive Micellization in HCl Aqueous Solution," Langmuir, 2008, 24, 3122-3126; Velasquez et al., Poly(vinylidene chloride)-Based Amphiphilic Block Copolymers, Marcromolecules, 2013, 46, 664-673; and U.S. Publication Nos. 2013/0030131, 2008/0045687, each of which is incorporated herein by reference.

The CDs, functionalized CDs, CD-functionalized polymers, inclusion complexes of poly(methyl methacrylate) and polycyclic aromatic hydrocarbons, and amphiphilic block copolymer can optionally be dissolved in ionic liquids, supercritical fluids, or both. Alternatively, they can be used without an ionic liquid, or supercritical fluid, if desired.

Ionic liquids are non-aqueous, organic salts composed of ions where the positive ion is charge balanced with a negative ion. These materials have low melting points, often below 100° C., undetectable vapor pressure, and good chemical and thermal stability. The cationic charge of the salt is localized over hetero atoms, such as nitrogen, phosphorous, sulfur, arsenic, boron, antimony, and aluminum, and the anions may be any inorganic, organic, or organometallic species. Suitable ionic liquids include, but are not limited to, imidazolium-based ionic liquids, pyrrolidinium-based ionic liquids, pyridinium-based ionic liquids, sulphonium-based ionic liquids, phosphonium-based ionic liquids, and ammonium-based ionic liquids, and combinations thereof.

Supercritical fluids are substances at a temperature and pressure above the critical point, where distinct liquid and gas phases do not exist. They have properties of both liquids and vapors. Suitable supercritical fluids include, but are not limited to, supercritical carbon dioxide, supercritical ammonia, supercritical ethane, supercritical propane, supercritical butane, and supercritical water, and combinations thereof. In some embodiments, the gas fraction from the separation zone can be used as the source of the carbon dioxide or ammonia for the supercritical carbon dioxide or supercritical ammonia.

Alternatively, the decontaminated coal tar stream 36 is sent to treatment zone 37 and contacted with an adsorbent. The adsorption is typically performed at temperatures between about 0° C. and about 150° C. In one embodiment, after the adsorbent bed is fully loaded to capacity, a desorbent is introduced into the bed, and the product 39 is then recovered from the desorbent/product mixture. Alternatively, the bed can be heated to remove the adsorbed product. In some embodiments, the coal tar stream is piped to another adsorbent bed during desorption of the first bed.

The adsorbent comprises exfoliated graphite oxide, thermally exfoliated graphite oxide or intercalated graphite compounds. Exfoliated graphite oxide, thermally exfoliated graphite oxide, and intercalated graphite compounds are described in Hristea et al., Characterization of Exfoliated Graphite for Heavy Oil Sorption, J.Thermal Anal. And Calorimetry, Vol. 91 (2008) 3, 817-823; Tryba et al., Influence of chemically prepared $H_2SO_4$-graphite intercalation compound (GIC) precursor on parameters of exfoliated graphite (EG) for oil sorption from water, Carbon, 41 (2002) 2009-2025; Tryba et al., Exfoliated graphite as a New Sorbent for Removal of Engine Oils from Wastewater, Spill Science and Tech. Bull., Vol. 8, Nos. 5-6, 569-571; Toyoda et al., Heavy oil sorption using exfoliated graphite New application of exfoliated graphite to protect heavy oil pollution, Carbon, 38 (2000) 199-210; and U.S. Pat. No. 7,658,901, each of which is incorporated herein by reference.

The products 39 from the extraction or adsorption process include, but are not limited to, benzene, alkylbenzenes, polyalkylbenzenes, naphthalenes, alkylnaphthalenes, polyalkylnaphthalenes, biphenyls, substituted biphenyls, oxygenates, and combinations thereof.

In some embodiments, at least two products are removed from the decontaminated coal tar stream 36. The first product can be removed using a first extraction agent or adsorbent, and then the second product can removed using a second extraction agent or adsorbent.

The viscosity of the coal tar stream can be reduced before it is contacted with the extraction agent or adsorbent using any suitable method, if desired. The viscosity can be reduced before or after the optional contaminant removal zone, for example. Suitable methods for reducing the viscosity of the coal tar stream include, but are not limited to, mixing the coal tar stream with a solvent (not shown).

After removing the at least one product, the coal tar feed 40 is sent to a separation zone 45 where it is separated into two or more fractions. Coal tar comprises a complex mixture of heterocyclic aromatic compounds and their derivatives with a wide range of boiling points. The number of fractions and the components in the various fractions can be varied as is well known in the art. A typical separation process involves separating the coal tar into four to six streams. For example, there can be a fraction comprising $NH_3$, CO, and light hydrocarbons, a light oil fraction with boiling points between 0° C. and 180° C., a middle oil fraction with boiling points between 180° C. to 230° C., a heavy oil fraction with boiling points between 230 to 270° C., an anthracene oil fraction with boiling points between 270° C. to 350° C., and pitch.

The light oil fraction contains compounds such as benzenes, toluenes, xylenes, naphtha, coumarone-indene, dicyclopentadiene, pyridine, and picolines. The middle oil fraction contains compounds such as phenols, cresols and cresylic acids, xylenols, naphthalene, high boiling tar acids, and high boiling tar bases. The heavy oil fraction contains benzene absorbing oil and creosotes. The anthracene oil fraction contains anthracene. Pitch is the residue of the coal tar distillation containing primarily aromatic hydrocarbons and heterocyclic compounds.

As illustrated, the coal tar feed 40 is separated into gas fraction 50 containing gases such as $NH_3$ and CO as well as light hydrocarbons, such as ethane, hydrocarbon fractions 55, 60, and 65 having different boiling point ranges, and pitch fraction 70.

Suitable separation processes include, but are not limited to fractionation, solvent extraction, and adsorption.

One or more of the fractions 50, 55, 60, 65, 70 can be further processed, as desired. As illustrated, fraction 60 can be sent to one or more hydrocarbon conversion zones 75, 80. For example, where hydrocarbon conversion zone 80 includes a catalyst which is sensitive to sulfur, fraction 60 can be sent to hydrocarbon conversion zone 75 for hydrotreating to remove sulfur and nitrogen. Effluent 85 is then sent to hydrocarbon conversion zone 80 for hydrocracking, for example, to produce product 90. Suitable hydrocarbon conversion zones include, but are not limited to, hydrotreating zones, hydrocracking zones fluid catalytic cracking zones, alkylation zones, transalkylation zones, oxidation zones and hydrogenation zones.

Hydrotreating is a process in which hydrogen gas is contacted with a hydrocarbon stream in the presence of suitable catalysts which are primarily active for the removal of heteroatoms, such as sulfur, nitrogen, oxygen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 27.6 MPa (4000 psig), a liquid hourly space velocity of about 0.5 $hr^{-1}$ to about 4 $hr^{-1}$, and a hydrogen rate of about 168 to about 1,011 $Nm^3/m^3$ oil (1,000-6,000 scf/bbl). Typical hydrotreating catalysts include at least one Group VIII metal, preferably iron, cobalt and nickel, and at least one Group VI metal, preferably molybdenum and tungsten, on a high surface area support material, preferably alumina Other typical hydrotreating catalysts include zeolitic catalysts, as well as noble metal catalysts where the noble metal is selected from palladium and platinum.

Hydrocracking is a process in which hydrocarbons crack in the presence of hydrogen to lower molecular weight hydrocarbons. Typical hydrocracking conditions may include a temperature of about 290° C. (550° F.) to about 468° C. (875° F.), a pressure of about 3.5 MPa (500 psig) to about 20.7 MPa (3000 psig), a liquid hourly space velocity (LHSV) of about 1.0 to less than about 2.5 $hr^{-1}$, and a hydrogen rate of about 421 to about 2,527 $Nm^3/m^3$ oil (2,500-15,000 scf/bbl). Typical hydrocracking catalysts include amorphous silica-alumina bases or low-level zeolite bases combined with one or more Group VIII or Group VIB metal hydrogenating components, or a crystalline zeolite cracking base upon which is deposited a Group VIII metal hydrogenating component. Additional hydrogenating components may be selected from Group VIB for incorporation with the zeolite base.

Fluid catalytic cracking (FCC) is a catalytic hydrocarbon conversion process accomplished by contacting heavier hydrocarbons in a fluidized reaction zone with a catalytic particulate material. The reaction in catalytic cracking is carried out in the absence of substantial added hydrogen or the consumption of hydrogen. The process typically employs a powdered catalyst having the particles suspended in a rising flow of feed hydrocarbons to form a fluidized bed. In representative processes, cracking takes place in a riser, which is a vertical or upward sloped pipe. Typically, a pre-heated feed is sprayed into the base of the riser via feed nozzles where it contacts hot fluidized catalyst and is vaporized on contact with the catalyst, and the cracking occurs converting the high molecular weight oil into lighter components including liquefied petroleum gas (LPG), gasoline, and a distillate. The catalyst-feed mixture flows upward through the riser for a short period (a few seconds), and then the mixture is separated in cyclones. The hydrocarbons are directed to a fractionator for separation into LPG, gasoline, diesel, kerosene, jet fuel, and other possible fractions. While going through the riser, the cracking catalyst is deactivated because the process is accompanied by formation of coke which deposits on the catalyst particles. Contaminated catalyst is separated from the cracked hydrocarbon vapors and is further treated with steam to remove hydrocarbon remaining in the pores of the catalyst. The catalyst is then directed into a regenerator where the coke is burned off the surface of the catalyst particles, thus restoring the catalyst's activity and providing the necessary heat for the next reaction cycle. The process of cracking is endothermic. The regenerated catalyst is then used in the new cycle. Typical FCC conditions include a temperature of about 400° C. to about 800° C., a pressure of about 0 to about 688 kPa g (about 0 to 100 psig), and contact times of about 0.1 seconds to about 1 hour. The conditions are determined based on the hydrocarbon feedstock being cracked, and the cracked products desired. Zeolite-based catalysts are commonly used in FCC reactors, as are composite catalysts which contain zeolites, silica-aluminas, alumina, and other binders.

Transalkylation is a chemical reaction resulting in transfer of an alkyl group from one organic compound to another. Catalysts, particularly zeolite catalysts, are often used to effect the reaction. If desired, the transalkylation catalyst may be metal stabilized using a noble metal or base metal, and may contain suitable binder or matrix material such as inorganic oxides and other suitable materials. In a transalkylation process, a polyalkylaromatic hydrocarbon feed and an aromatic hydrocarbon feed are provided to a transalkylation reaction zone. The feed is usually heated to reaction temperature and then passed through a reaction zone, which may comprise one or more individual reactors. Passage of the combined feed through the reaction zone produces an effluent stream comprising unconverted feed and product monoalkylated hydrocarbons. This effluent is normally cooled and passed to a stripping column in which substantially all C5 and lighter hydrocarbons present in the effluent are concentrated into an overhead stream and removed from the process. An aromatics-rich stream is recovered as net stripper bottoms, which is referred to as the transalkylation effluent.

The transalkylation reaction can be effected in contact with a catalytic composite in any conventional or otherwise convenient manner and may comprise a batch or continuous type of operation, with a continuous operation being preferred. The transalkylation catalyst is usefully disposed as a fixed bed in a reaction zone of a vertical tubular reactor, with the alkylaromatic feed stock charged through the bed in an upflow or downflow manner. The transalkylation zone normally operates at conditions including a temperature in the range of about 130° C. to about 540° C. The transalkylation zone is typically operated at moderately elevated pressures broadly ranging from about 100 kPa to about 10 MPa absolute. The transalkylation reaction can be effected over a wide range of space velocities. That is, volume of charge per volume of catalyst per hour, weight hourly space velocity (WHSV), is generally in the range of from about 0.1 to about 30 $hr^{-1}$. The catalyst is typically selected to have relatively high stability at a high activity level.

Alkylation is typically used to combine light olefins, for example mixtures of alkenes such as propylene and butylene, with isobutane to produce a relatively high-octane branched-chain paraffinic hydrocarbon fuel, including isoheptane and isooctane. Similarly, an alkylation reaction can be performed using an aromatic compound such as benzene in place of the isobutane. When using benzene, the product resulting from the alkylation reaction is an alkylbenzene (e.g. toluene, xylenes, ethylbenzene, etc.). For isobutane alkylation, typically, the reactants are mixed in the presence of a strong acid catalyst, such as sulfuric acid or hydrofluoric acid. The alkylation reaction is carried out at mild temperatures, and is typically a two-phase reaction. Because the reaction is exothermic, cooling is needed. Depending on the catalyst used, normal refinery cooling water provides sufficient cooling. Alternatively, a chilled cooling medium can be provided to cool the reaction. The catalyst protonates the alkenes to produce reactive carbocations which alkylate the isobutane reactant, thus forming branched chain paraffins from isobutane. Aromatic alkylation is generally now conducted with solid acid catalysts including zeolites or amorphous silica-aluminas.

The alkylation reaction zone is maintained at a pressure sufficient to maintain the reactants in liquid phase. For a hydrofluoric acid catalyst, a general range of operating pressures is from about 200 to about 7100 kPa absolute. The temperature range covered by this set of conditions is from about −20° C. to about 200° C. For at least alkylation of aromatic compounds, the volumetric ratio of hydrofluoric acid to the total amount of hydrocarbons entering the reactor should be maintained within the broad range of from about 0.2:1 to about 10:1, preferably from about 0.5:1 to about 2:1.

Oxidation involves the oxidation of hydrocarbons to oxygen-containing compounds, such as aldehydes. The hydrocarbons include alkanes, alkenes, typically with carbon numbers from 2 to 15, and alkyl aromatics, Linear, branched, and cyclic alkanes and alkenes can be used. Oxygenates that are not fully oxidized to ketones or carboxylic acids can also be subjected to oxidation processes, as well as sulfur compounds that contain -S-H moieties, thiophene rings, and sulfone groups. The process is carried out by placing an oxidation catalyst in a reaction zone and contacting the feed stream which contains the desired hydrocarbons with the catalyst in the presence of oxygen. The type of reactor which can be used is any type well known in the art such as fixed-bed, moving-bed, multi-tube, CS IR, fluidized bed, etc. The feed stream can be flowed over the catalyst bed either up-flow or down-flow in the liquid, vapor, or mixed phase. In the case of a fluidized-bed, the feed stream can be flowed co-current or counter-current. In a CSTR the feed stream can be continuously added or added batch-wise. The feed stream contains the desired oxidizable species along with oxygen. Oxygen can be introduced either as pure oxygen or as air, or as liquid phase oxidants including hydrogen peroxide, organic peroxides, or peroxy-acids. The molar ratio of oxygen ($O_2$) to substrate to be oxidized can range from about 5:1 to about 1:10. In addition to oxygen and alkane or alkene, the feed stream can also contain a diluent gas selected form nitrogen, neon, argon, helium, carbon dioxide, steam or mixtures thereof As stated, the oxygen can be added as air which could also provide a diluent. The molar ratio of diluent gas to oxygen ranges from greater than zero to about 10:1, The catalyst and feed stream are reacted at oxidation conditions which include a temperature of about 25° C. to about 600° C., a pressure of about 101 kPa to about 5,066 kPa and a space velocity of about 100 to about 100,000 $hr^{-1}$.

Hydrogenation involves the addition of hydrogen to hydrogenatable hydrocarbon compounds. Alternatively hydrogen can be provided in a hydrogen-containing compound with ready available hydrogen, such as tetralin, alcohols, hydrogenated naphthalenes, and others via a transfer hydrogenation process with or without a catalyst. The hydrogenatable hydrocarbon compounds are introduced into a hydrogenation zone and contacted with a hydrogen-rich gaseous phase and a hydrogenation catalyst in order to hydrogenate at least a portion of the hydrogenatable hydrocarbon compounds. The catalytic hydrogenation zone may contain a fixed, ebulated or fluidized catalyst bed. Alternatively the hydrogenation process can be carried out in the liquid phase in a CSTR. This reaction zone is typically at a pressure from about 689 k Pa gauge (100 psig) to about 13790 k Pa gauge (2000 psig) with a maximum catalyst bed temperature in the range of about 177° C. (350° F.) to about 454° C. (850° F.). The liquid hourly space velocity is typically in the range from about 0.2 $hr^{-1}$ to about 10 $hr^{-1}$ and hydrogen circulation rates from about 200 standard cubic feet per barrel (SCFB) (35.6 $m^3/m^3$) to about 10,000 SCFB (1778 $m^3/m^3$).

In some processes, all or a portion of the coal feed 10 is mixed with oxygen 95 and steam 100 and reacted under heat and pressure in the gasification zone 20 to form syngas 105, which is a mixture of carbon monoxide and hydrogen. The syngas 105 can be further processed using the Fischer-Tropsch reaction to produce gasoline or using the water-gas shift reaction to produce more hydrogen.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for removing at least one product from coal tar comprising:

providing a coal tar stream;

removing at least one product from the coal tar stream by extraction with an extraction agent or adsorption with an adsorbent to form a treated coal tar steam, the extraction agent comprising an amphiphilic block copolymer comprising at least two blocks selected from polyethylene oxide blocks, polypropylene oxide blocks, butylene oxide blocks, silicone blocks, urethane blocks, polyurethane ionomer blocks, acrylate ionomer blocks, polymethylacryate blocks, polyacrylic acid blocks, or polyvinylidene chloride blocks and the adsorbent comprising exfoliated graphite oxide, thermally exfoliated graphite oxide or intercalated graphite compounds;

recovering the at least one product; and separating the treated coal tar stream into at least two fractions.

2. The process of claim 1 wherein the extraction agent further comprises an ionic liquid, or a supercritical fluid, or both.

3. The process of claim 2 wherein the extraction agent further comprises the ionic liquid, and wherein the ionic liquid comprises imidazolium-based ionic liquid, pyrrolidinium-based ionic liquid, pyridinium-based ionic liquid, sulphonium-based ionic liquids, phosphonium-based ionic liquids, ammonium-based ionic liquids, or combinations thereof.

4. The process of claim 2 wherein the extraction agent further comprises the supercritical fluid, and wherein the supercritical fluid comprises supercritical carbon dioxide, supercritical ammonia, supercritical ethane, supercritical propane, supercritical butane, supercritical water, or combinations thereof.

5. The process of claim 4 wherein the supercritical fluid is the supercritical ammonia, wherein one of the separated fractions comprises ammonia, and wherein the ammonia in the one fraction is processed into the supercritical ammonia.

6. The process of claim 4 wherein the supercritical fluid is the supercritical carbon dioxide, wherein one of the separated fractions comprises carbon dioxide, and wherein the carbon dioxide in the one fraction is processed into the supercritical carbon dioxide.

7. The process of claim 1 wherein the at least one product comprises benzene, alkylbenzenes, polyalkylbenzenes, naphthalenes, alkylnaphthalenes, polyalkylnaphthalenes, biphenyls, substituted biphenyls, oxygenates, or combinations thereof.

8. The process of claim 1 wherein at least two products are removed, and wherein the first product is removed using a first extraction agent or adsorbent and wherein the second product is removed using a second extraction agent or adsorbent after the removal of the first product and before separating the treated coal tar stream into the at least two fractions.

9. The process of claim 1 further comprising dehydrating the coal tar stream before removing the at least one product.

10. The process of claim 1 further comprising processing at least one of the fractions to produce at least one additional product.

11. The process of claim 10 wherein the at least one fraction is processed by at least one of hydrotreating, hydrocracking, fluid catalytic cracking, alkylation, transalkylation, oxidation, and hydrogenation.

12. The process of claim 1 further comprising treating at least one recovered product to remove contaminants.

13. The process of claim 1 further comprising treating at least one of the fractions to remove contaminants.

14. A process for removing at least one product from coal tar comprising:

pyrolyzing a coal feed into a coal tar stream and a coke stream;

removing at least one product from the coal tar stream by extraction with an extraction agent or adsorption with an adsorbent to form a treated coal tar steam, wherein the extraction agent comprises an amphiphilic block copolymer comprising at least two blocks selected from polyethylene oxide blocks, polypropylene oxide blocks, butylene oxide blocks, silicone blocks, urethane blocks, polyurethane ionomer blocks, acrylate ionomer blocks, polymethylacryate blocks, polyacrylic acid blocks, or polyvinylidene chloride blocks wherein the adsorbent comprising exfoliated graphite oxide, thermally exfoliated graphite oxide or intercalated graphite compounds, and wherein the at least one product comprises benzene, alkylbenzenes, polyalkylbenzenes, naphthalenes, alkylnaphthalenes, polyalkylnaphthalenes, biphenyls, substituted biphenyls, oxygenates, or combinations thereof;

recovering the at least one product; and separating the treated coal tar stream into at least two fractions.

15. The process of claim 14 wherein the extraction agent further comprises the ionic liquid, and wherein the ionic liquid comprises imidazolium-based ionic liquid, pyrrolidinium-based ionic liquid, pyridinium-based ionic liquid, sulphonium-based ionic liquids, phosphonium-based ionic liquids, ammonium-based ionic liquids, or combinations thereof.

16. The process of claim 14 wherein the extraction agent further comprises the supercritical fluid, and wherein the supercritical fluid comprises supercritical carbon dioxide, supercritical ammonia, supercritical ethane, supercritical propane, supercritical butane, supercritical water, or combinations thereof.

17. The process of claim 14 further comprising dehydrating the coal tar stream before removing the at least one product.

18. The process of claim 14 further comprising processing at least one of the fractions to produce at least one additional product, wherein the at least one fraction is processed by at least one of hydrotreating, hydrocracking, fluid catalytic cracking, alkylation, transalkylation, oxidation, and hydrogenation.

* * * * *